US005834088A

United States Patent [19]

Pechhold

[11] Patent Number: 5,834,088

[45] Date of Patent: Nov. 10, 1998

[54] MALEIC ANHYDRIDE/OLEFIN POLYMER STAIN-RESISTS

[75] Inventor: Engelbert Pechhold, Chadds Ford, Pa.

[73] Assignee: E. I. du Pont de Nemours and Company, Wilmington, Del.

[21] Appl. No.: 931,137

[22] Filed: Sep. 16, 1997

Related U.S. Application Data

[62] Division of Ser. No. 593,296, Jan. 29, 1996, Pat. No. 5,707,708, which is a continuation of Ser. No. 350,349, Dec. 6, 1994, abandoned, which is a continuation-in-part of Ser. No. 126,149, Sep. 23, 1993, abandoned, which is a continuation of Ser. No. 809,843, Dec. 18, 1991, abandoned, which is a continuation-in-part of Ser. No. 626,885, Dec. 13, 1990, abandoned.

[51] Int. Cl.[6] ..... B32B 3/02

[52] U.S. Cl. ..... 428/96; 428/375; 428/378; 428/395; 442/168; 528/129; 528/143; 528/150; 526/272

[58] Field of Search ..... 428/96, 375, 378, 428/395; 442/168; 528/129, 143, 150; 526/272

[56] References Cited

U.S. PATENT DOCUMENTS

| | | | |
|---|---|---|---|
| 3,897,206 | 7/1975 | Kearney | 8/120 |
| 4,038,027 | 7/1977 | Kearney | 8/120 |
| 4,144,026 | 3/1979 | Keller et al. | 8/115.6 |
| 4,623,683 | 11/1986 | Villarreal et al. | 524/47 |

FOREIGN PATENT DOCUMENTS

| | | |
|---|---|---|
| 0 306 992 | 3/1989 | European Pat. Off. . |
| 0 329 899 | 8/1989 | European Pat. Off. . |

*Primary Examiner*—Helen L. Pezzuto

[57] ABSTRACT

A polyamide fibrous substrate having deposited on it an amount of a composition effective to impart stain-resistance comprising a water-soluble or water-dispersible alpha-olefin/maleic anhydride polymer or a mixture of said polymers, and processes for preparing the substrates. The maleic anhydride polymer is used either in hydrolyzed form or in the form resulting from reacting it with a lower alkyl alcohol so as to form an alpha-olefin/maleic acid monalkyl ester polymer.

11 Claims, No Drawings

MALEIC ANHYDRIDE/OLEFIN POLYMER STAIN-RESISTS

This is a division of application Ser. No. 08/593,296, filed Jan. 29, 1996, now U.S. Pat. No. 5,707,708 which is a continuation of application Ser. No. 08/350,349, filed Dec. 6, 1994, abandoned, which is a continuation-in-part of application Ser. No. 08/126,149, filed Sep. 23, 1993, abandoned, which is a continuation of application Ser. No. 07/809,843, filed Dec. 18, 1991, abandoned, which is a continuation-in-part of application Ser. No. 07/626,885, filed Dec. 13, 1990, now abandoned.

FIELD OF THE INVENTION

The present invention relates to polyamide textile substrates treated with stain-resistant compositions comprising water-soluble or water-dispersible maleic anhydride/alpha-olefin polymers, and processes for their synthesis. The substrates of this invention possess stain-resistance but do not suffer from yellowing to the extent that some previously known materials do.

BACKGROUND OF THE INVENTION

Polyamide substrates, such as nylon carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a highly fluorinated polymer to the substrate. Another is to use a composition containing a sulfonated phenol-formaldehyde condensation product.

For example, Liss et al., in U.S. Pat. No. 4,963,409, disclose stain-resistant synthetic polyamide textile substrates having deposited on them sulfonated phenol-formaldehyde polymeric condensation products. However, sulfonated phenol-formaldehyde condensation products are themselves subject to discoloration; commonly they turn yellow. Yellowing problems are described by W. H. Herrunpel in a Mar. 19, 1982 article in *America's Textiles*, entitled Reversible Yellowing Not Finisher's Fault. Hemnmpel attributes yellowing to exposure of a phenol-based finish to nitrogen oxides and/or ultraviolet radiation. To deal with the yellowing problem, the condensation products were modified by Liss et al. by acylation or etherification of some of the phenolic hydroxyls. In a preferred embodiment disclosed by Liss et al., the modified condensation products were dissolved in a hydroxy-containing solvent, such as ethylene glycol prior to there being applied to the textile substrate.

Allen et al., in U.S. Pat. No. 3,835,071, disclose rug shampoo compositions which upon drying leave very brittle, non-tacky residues which are easily removed when dry. The compositions comprise water-soluble metal, ammonium or amine salt of a styrene-maleic anhydride copolymer, or its half ester, and a detergent. Water-soluble metal salts of Group II and the alkali metals (particularly magnesium and sodium) are preferred and ammonium salts are most preferred by Allen et al.

On the other hand, Fitzgerald et al., in U.S. patent application Ser. No. 07/502819, filed Apr. 2, 1990, now U.S. Pat. No. 5,001,004 disclose the usefulness of aqueous solutions of hydrolyzed vinylaromatic/maleic anhydride copolymers in the treatment of textiles to render them resistant to staining. The preferred copolymer of Fitzgerald et al. is a hydrolyzed styrene/maleic anhydride copolymer. Fitzgerald et al. disclose that the monoalkyl ester of their maleic anhydride/vinyl aromatic polymer was ineffective as a stain-resist.

Maleic anhydride/alpha-olefin polymers are known. Reissue U.S. Pat. No. 28,475 discloses copolymerization of maleic anhydride and 1-olefins, such as, 1-hexene, 1-tetradecene and 1-octadecene. European Patent Application No. 306.992 published 15 Mar. 1989 discloses maleic anhydride/-1-alkene Terpolymerization of Maleic Anhydride With Vinyl Monomers, *J. Polymer SGI., Part A: Polym. Chem.,* 27 (12). 4099-108, disclose terpolymers of maleic anhydride with (i) 1-hexene, propylene, isobutylene, styrene, isoprene or 1,3-butadiene, and (ii) methyl methacrylate, methyl acrylate or acrylonitrile.

BRIEF SUMMARY OF THE INVENTION

The present invention provides polyamide fibrous substrates treated with water-soluble or water-dispersible maleic anhydride/alpha-olefin polymers so as to impart stain-resistance to the substrates, and methods for preparing the same. Commonly, prior are materials known to be useful as stain-blockers were sulfonated phenol-formaldehyde condensates (excepting those of Fitzgerald et al., supra). Finding a non-sulfonated material, such as the water-soluble or water-dispersible alpha-olefin/maleic anhydride polymers of this invention, to be useful for this purpose was unexpected.

DETAILED DESCRIPTION OF THE INVENTION

The present invention relates to the use of water-soluble or water-dispersible maleic anhydride/alpha-olefin polymers, or mixtures of the same, as stain-resists for fibrous polyamides. A variety of linear and branched chain alpha-olefins can be used for the purposes of this invention. Particularly useful alpha-olefins are 1-alkenes, containing 4 to 12 carbon atoms, preferably $C_{4-10}$, such as isobutylene, 1-butene, 1-hexene, 1-octene, 1-decene, and dodecene, with isobutylene and 1-octene being preferred and 1-octene being most preferred. A part of the alpha-olefins can be replaced by other monomers, with isobutylene being most preferred. A part of the alpha-olefins can be replaced by other monomers, e.g. up to 50 wt. % of alkyl($C_{1-4}$) acrylates, alkyl($C_{1-4}$) methacrylates, vinyl acetate, vinyl chloride, vinylidine chloride, vinyl sulfides, N-vinyl pyrrolidone, acrylonitrile, acrylamide, as well as mixtures of the same.

In accordance with the present invention, it has been unexpectedly found that water-soluble or water-dispersible interpolymers (i.e. copolymers, terpolymers, and the like) of maleic anhydride and one or more 1-alkenes having 4 to 12 carbon atoms, particularly isobutylene and 1-octene, impart excellent stain-resistance to polyamide substrates (e.g. carpeting) at low pH. Copolymers of maleic anhydride with butadiene, ethylene, propylene or a 1-alkene containing having 14 to 24 carbon atoms were found by the inventor to be unsatisfactory for commercial purposes as stain-resists on such substrates.

A part of the maleic anhydride (up to 30 weight %) can be replaced by acrylic or methacrylic acid. In another embodiment, a part (1–75%) of the maleic anhydride can be replaced by maleimide, N-alkyl($C_{1-4}$) maleimides, N-phenylmaleimide, fumaric acid, crotonic acid, cinnamic acid, alkyl($C_{1-18}$) esters of the foregoing acids, cycloalkyl ($C_{3-8}$) esters of the foregoing acids, sulfated castor oil, or the like. At least 95 wt. % of the maleic anhydride co- or terpolymers having a number average molecular weight of in the range between about 700 and 200,000, preferably between about 1000 and 100,000.

The maleic anhydride polymers useful in the present invention can be prepared according to methods well-known in the art. The maleic anhydride polymers thus obtained can be hydrolyzed to the free acid or their salts by reaction with water or alkali, or they can also be reacted with $C_{1-4}$ alkyl alcohol to provide polymeric alpha-olefin/maleic acid monoesters, which have stainblocking properties. Generally, the hydrolyzed maleic anhydride polymer, or the monoester polymer, should be sufficient water-soluble that uniform application to a fibrous polyamide surface can be achieved at an appropriate acidity. However, applications using water dispersions of the polymer mixed with a suitable surfactant may be used to impart stain-resistance.

One can blend the stain-resists of the present invention with other known stain-resists, such as phenol-formaldehyde condensation products as disclosed in U.S. Pat. Nos. 4,833,009 and 4,965,325; methaclylic acid polymers disclosed in U.S. Pat. No. 4,937,123; or hydrolyzed polymers of maleic anhydride and one or more ethylenically unsaturated aromatic compounds described by Fitzgerald et al., supra.

The polymers suitable for the purposes of this invention contain between about 0.4 and 1.3 polymer units derived from one or more olefin monomers per polymer unit derived from maleic anhydride. The alpha-olefin content of the polymers of this invention comprise between (a) 100 and 80 mol % of at least one 1-alkene containing 4 to 12 carbon atoms and (b) 0 to 20 mol % of at least one 1-alkene containing 3, or 14 to 24, carbon atoms. Polymers containing about one polymer unit derived from one or more olefin monomers per polymer unit derived from maleic anhydride are most effective in imparting stain resistance to textile substrates. The molecular weight of the polymers useful in the invention does not appear to be a limitation so long as the polymers are water-soluble or water-dispersible. Thus, for example, hydrolyzed isobutylene/maleic anhydride copolymers having number average molecular weights between about 6000 and 100,000 impart good stain-resistance to polyamide substrates. Even at a pH as low as 1.5, water-soluble isobutylene/maleic anhydride copolymers having number average molecular weights between about 6000 and 100,000 remained in solution in water at 60° C.

The polymers suitable for the purposes of this invention can be prepared by hydrolyzing the maleic anhydride/olefin polymers according to methods well-known in the art. For example, they can be hydrolyzed to the free acid or their salts by reaction with water of alkali. Generally, the maleic anhydride polymer should be sufficiently water-soluble that uniform application to a fiber surface can be achieved at an appropriate acidity. However, applications using dispersions of the polymers with suitable surfactants may be used to impart stain-resistance.

Suitable maleic anhydride polymers can be conveniently obtained by hydrolysis of "Isobam"-01, an isobutylene maleic anhydride copolymer of molecular weight around 10,000, "Isobam"-04 a similar polymer having a molecular weight of around 40,000 or "Isobam"-10 a similar polymer having a molecular weight of around 100,000 with sodium hydroxide. Other suitable maleic anhydride polymers include BM-30 available from Kuraray Co. (Japan). BM-30 is an isobutylene/maleic anhydride/N-phenylmaleirnide terpolymer having a molecular weight of around 40,000. Other suitable copolymers include monoesters of $C_{4-12}$ alpha-olefin/maleic anhydride copolymers. The monoesters can be obtained by a range of reactions well known to those skilled in the art. A preferred method is by reaction with an alcohol by heating under reflux with the alcohol and then removing excess alcohol. Preferred alcohols are $C_{1-4}$ alcohols, especially methanol and ethanol.

Preparation of maleic anhydride/alpha-olefin polymers is also described in Reissue U.S. Pat. No. 28,475, in EP 306992 and by Florjanczyk et al. in J. Polymer SCI., Part A, Polymer Chem., 27 (12) pages 4099 to 4108, the disclosure of which is specifically incorporated by reference. These references contain further teaching of techniques for the preparation of such polymers.

The olefin/maleic anhydride polymers of this invention can be used as such in treating polyamide textile substrates. They can be effectively applied to polyamide fibrous substrates by a wide variety of methods known to those skilled in the art, such as:

padding, spraying, foaming in conjunction with foaming agents, batch exhaust in beck dyeing equipment, or continuous exhaust during a continuous dyeing operation. They can be applied by such methods to dyed or undyed polyamide textile substrates. In addition, they can be applied to such substrates in the absence or presence of a polyfluoroorganic oil-, water-, and/or soil-repellent materials. In the alternative, such a polyfluoroorganic material can be applied to the textile substrate before or after application of the polymers of this invention thereto.

The quantities of the polymers of this invention which are applied to the textile substrate are amounts effective in imparting stain-resistance to the substrate. Those amounts can be varied widely; in general, one can use between 1 and 5% by weight of them based on the weight of the textile substrate, usually 2.5% by weight or less. The polymers can be applied, as is common in the art, at pHs ranging between about 2 an d7. However, more effective exhaust deposition can be obtained at a pH as low as 1.5. When the latter low pH is used, the preferred level of application to the textile substrate is about 2.5% by weight, based on the weight of the textile substrate. In an embodiment, a pH between about 2 and 3 is used. More effective stainblocking is obtained if the polymers are applied to the textile substrate at either 20° C. followed by heat treatment at a temperature in the range between about 50 and 150° C. for about 1 to 60 minutes, or applied at temperatures in the range between about 40° and 95° C. for about 1 to 60 minutes. For example, at a pH between about 2 and 3, a temperature between about 70° and 90° C. is preferred. However, stain-blocking can be obtained when application is effected even at that of cold tap water (10°–15° C.

The polymers of this invention can also be applied in-place to polyamide carpeting which has already been installed in a dwelling place, office or other locale. They can be applied as a simple aqueous preparation or in the form of aqueous shampoo preparation, with or without one or more polyfluoroorganic oil-, water-, and/or soil-repellent materials. They may be applied at the levels described 10 above, at temperatures described, and at a pH between about 1 and 12, preferably between about 2 and 9.

The following Examples are given to illustrate the invention not limit it. Unless otherwise indicated, all parts and percentages are by weight and temperature sin the Examples and Tests are in degrees Celsius. In the examples that follow, stain resistance was measured by the technique described below.

EXAMPLE 1

An isobutylene/maleic anhydride copolymer (10 g) having a number average molecular weight (GPC) of 32,600 and an $MW/M_n$ of 2.96, commercially available from Kuraray Co. (Japan) as "Isobam"-04, was hydrolyzed to a 10 wt. % solution in accordance with the method described in Example 2. A 1% aqueous solution of the resulting isobutylene/maleic acid copolymer remained clear down to pH 1.5 at 60° C.

EXAMPLE 2

An isobutylene/maleic anhydride copolymer (10 g) having a number average molecular weight (GPC) of 91,400 and an $MW/M_n$ of 2.86, commercially available from Kuraray Co. (Japan) as "Isobam"-10, was hydrolyzed to a 10 wt. % solution in accordance with the method described in Example 2. A 1% aqueous solution of the resulting water-soluble maleic anhydride/isobutylene copolymer at 60° C. became cloudy at pH 1.6.

EXAMPLE 3

An isobutylene/maleic anhydride/ N-phenylmaleimide terpolymer (10 g) having a molecular weight 40,000 (GPC), commercially available from Kuraray Co. (Japan) as BM-30 polymer, was hydrolyzed to a 10 wt. % solution by the method described in Example 2. A 1% aqueous solution of the resulting water-soluble maleic anhydride/isobutylene/ maleimide terpolymer at 60° C. became cloudy at pH 2.5.

EXAMPLE 4

A solution of maleic anhydride (9.8 g–0.1 mol) and 1-hexene (8.4 g–0.1 mole) in propylene glycol methyl ether acetate (30 g) was heated under agitation and nitrogen to 60 deg.C. A solution of 2.5 g of 75 wt. % t-butyl peroxyneodecanoate in 6 g of propylene glycol methyl ether acetate was then injected into the reaction vessel within half hour via a syringe pump. The reactants were agitated for another 2 hours at 60° C. before being cooled to room temperature. The product was the poured into methanol which caused precipitation of a white solid which was filtered and air dried to give 10.5 g of a maleic anhydride/1-hexene copolymer. Hydrolysis was carried out by a procedure similar to that described in Example 2.

EXAMPLE 5

A solution of 9.8 g of maleic anhydride (0.1 mole) and 11.2 g of 1-octene (0.1 mole) in 30 g of propylene glycol methyl ether acetate was heated under agitation and nitrogen to 95° C. A solution of 2 g of t-butyl peroxy-2-ethylhexanoate in 6 g of propylene glycol methyl ether acetate was then injected into the reaction vessel within half hour via a syringe pump. The reactants were agitated for another 2 hours at 95° C. before being cooled to room temperature. The product was then poured into methanol which caused precipitation of a white solid which was filtered and air-dried to give 12.7 g of a maleic acid/1-octene copolymer having a number 2 0 average molecular weight by vapor phase osmometry (VPO) of 2800. The approximate composition of the copolymer by $^{13}$CNMR:

1-octene/maleic anhydride=0.72/1.00. Hydrolysis was carried out by a procedure similar to that of Example 2. A 1% aqueous solution of the resulting maleic acid/1-octene copolymer at 60° C. became cloudy at about pH 2.7.

EXAMPLE 6

The procedures for preparation and hydrolysis were similar to those of Example 5.

Reactants: 9.8 g of maleic anhydride (0.1 mole) 16.8 g 1-dodecene (0.1 mole).

EXAMPLE 7

An isobutylene/maleic anhydride copolymer (50 parts) having a number average molecular weight (GPC) of 32,000, commercially available from Kuraray Co. (Japan) as "Isobam"-04, was reacted under agitation with methanol (50 parts) at reflux temperature (about 65° C.) for 23 hours. Excess methanol was then removed at reduced pressure (20 mm Hg) at 70°–90° C. to give the isobutylene/maleic acid monomethyl ester which was then dissolved at room temperature in dilute ammonium hydroxide (2.5 parts of ammonia in 356 parts of water) to give a 14.5 wt. % solution.

EVALUATION METHOD

Nylon fiber was treated with 1.2 wt. % or 2.4 wt. % stain resist at a good-to-liquor ratio of 1:32 at a pH of 2.0 or 2.35 for 45 minutes at 80 or 95° C. The fiber was then washed, air-dried and exposed at room temperature to a dye solution consisting of 0.2 g of FD&C Red Dye No. 40 and 3.2 g of citric acid in 1 liter of deionized water at a goods-to-liquor ratio of 1:40. After approximately 65 hours, the dye adsorbed onto the fiber was determined at a wavelength of 498–502 nm by comparing the absorbance with that of the Control. Thus a number of 90 means 90% of the dye is adsorbed, indicating little stain resistance to the dye. The lower the number, the better is the resistance to stain. The results of the evaluation are in TABLE 1.

TABLE 1

| | % Dye Adsorbed | | | |
|---|---|---|---|---|
| | | At 80° C. | At 95° C. | |
| EXAMPLE | pH 2.0 | pH 2.35 | pH 2.35 | pH 2.35* |
| 1 | 2 | 3 | 3 | |
| 2 | | 2 | 1 | 1 |
| 3 | | 2 | 3 | 1 |
| 4 | | 3 | 30 | 1 |
| 5 | | 4 | 2 | 1 |
| 6 | | 14 | 22 | |
| 7 | | 6 | 39 | 12 |
| CONTROL** | | | 89 | 89 |

*Fiber treated with 2.4 wt % stain resist
**No stainblocker

I claim:

1. A process for imparting resistance to a staining of a polyamide textile substrate by an acid dye which comprises applying to said substrate an effective amount of a composition comprising a water-soluble or water-dispersible 1-alkene/maleic anhydride polymer or a mixture of the same, wherein said polymer comprises polymer units derived from maleic anhydride and polymer units derived from one or more 1-alkenes at a molar ratio of between about 0.4 and 1.3 polymer units derived from one or more 1-alkene monomers per polymer unit derived from maleic anhydride, the alpha-olefin content of said polymer consisting essentially of between (a) 100 and 80 mol percent of at least one 1-alkene containing 4 to 12 carbon atoms and (b) 0 to 20 mol percent of at least one 1-alkene containing 3 or 14 to 24 carbon atoms.

2. The process of claim 1 wherein said polymer is a hydrolyzed polymer.

3. The process of claim 1 wherein said polymer is a 1-alkene/maleic acid monoalkyl ($C_{1-4}$) ester polymer.

4. The process of claim 1 wherein said polymer contains about one polymer unit derived from maleic anhydride per polymer unit derived from one or more 1-alkene monomers.

5. The process of claim 4 wherein said 1-alkene is isobutylene.

6. The process of claim 1 wherein said 1-alkene is 1-octene.

7. The process of claim 1 wherein at least 95 wt. % of said polymers have a number average molecular weight of about 700 to 200,000.

8. The process of claim 1 wherein at least 95 wt. % of said polymers have a number average molecular weight of about 1000 to 100,000.

9. The process of claim 1 wherein up to 50 weight % of said alpha-olefin is replaced by one or more of a $C_1$ to $C_4$ alkyl acrylate or methacrylate, vinyl acetate, vinyl chloride, vinylidine chloride, vinyl sulfide, N-vinyl pyrrolidone, acrylonitrile, or acrylamide, or mixtures of the same.

10. The process of claim 1 wherein up to 75 weight % of said maleic anhydride is replaced by maleimide, N-alkyl ($C_{1-4}$) maleimides, N-phenylmaleimide, fumaric acid, itaconic acid, citraconic acid, aconitic acid, crotonic acid, cinnamic acid, alkyl($C_{1-18}$) or cycloalkyl($C_{3-8}$) esters of the foregoing acids or sulfated castor oil.

11. The process of claim 1 wherein up to 30 weight % of the maleic anhydride is replaced by acrylic or methacrylic acid.

* * * * *